US008532519B2

(12) United States Patent
Hijikata et al.

(10) Patent No.: US 8,532,519 B2
(45) Date of Patent: Sep. 10, 2013

(54) IMAGE FORMING APPARATUS

(75) Inventors: Shunsuke Hijikata, Suntou-gun (JP); Taku Fukita, Mishima (JP); Tomoaki Imura, Mishima (JP); Takaaki Tsuruya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 311 days.

(21) Appl. No.: 13/096,382

(22) Filed: Apr. 28, 2011

(65) Prior Publication Data

US 2011/0274458 A1 Nov. 10, 2011

(30) Foreign Application Priority Data

May 10, 2010 (JP) ..... 2010-107939

(51) Int. Cl.
*G03G 21/00* (2006.01)

(52) U.S. Cl.
USPC ..... 399/98

(58) Field of Classification Search
USPC ..... 399/98, 92, 93
See application file for complete search history.

(56) References Cited

U.S. PATENT DOCUMENTS 5,155,531 A * 10/1992 Kurotori et al. ..... 399/93
6,920,304 B2 * 7/2005 Kanesawa et al. ..... 399/328
7,162,194 B2 1/2007 Hotta et al.
7,206,541 B2 4/2007 Fukita et al.
2001/0026703 A1 * 10/2001 Kushida ..... 399/93
2008/0219695 A1 * 9/2008 Doshohda et al. ..... 399/93
2010/0251894 A1 * 10/2010 Tanaka et al. ..... 96/17
2011/0243598 A1 * 10/2011 Suzuki ..... 399/98
2012/0141173 A1 * 6/2012 Iwasaki ..... 399/327

FOREIGN PATENT DOCUMENTS

JP 08-184992 7/1996
JP 2000-03070 1/2000
JP 2004-151240 5/2004
JP 2009-288578 12/2009
JP 2010-091663 4/2010

* cited by examiner

*Primary Examiner* — G. M. Hyder
(74) *Attorney, Agent, or Firm* — Fitzpatrick, Cella, Harper & Scinto

(57) ABSTRACT

The image forming apparatus including a fixing part that heats and fixes an unfixed toner image formed on a recording material, onto the recording material, an electric field generation member that forms an electric field in a space in which a component evaporated from a wax flows, the component being generated during the heating and fixing, and a collection member to which a voltage is applied, the collection member electrostatically collecting the component passing through the space in which the electric field has been formed. The image forming apparatus prevents conveyance failures resulting from evaporated components of a release wax adhering to parts within the image forming apparatus.

4 Claims, 9 Drawing Sheets

IMAGE FORMING APPARATUS

BACKGROUND OF THE INVENTION

1. Field of the Invention

The present invention relates an image forming apparatus including a fixing unit.

2. Description of the Related Art

Conventionally, a toner image formed on a recording sheet (hereinafter referred to as "recording material") using an electrophotographic process is subjected to heat-fixing processing by a fixing unit. A majority of the recent electrophotographic toners contain a release wax as a constituent material. A release wax is added in order to provide effects such as adjustment of the glossiness of a printed image and dispersibility of pigments as well as prevention of fixing offsets.

Here, there are some types of fixing-offset phenomena as described below. In a process of fixing toner onto a recording material, if the fixing roller or the fixing film is not sufficiently heated (has a low temperature), the toner is not sufficiently fused, and the strength of fixing on the recording material is decreased. Such a state may result in a part of the toner adhering to the fixing roller. Such phenomenon is called a "cold offset", and the part of the recording material in which the toner adheres to the fixing roller appears as a missing part of the image on the recording material. In addition, the fixed toner may fall out of the recording material due to, e.g., friction because of its weak fixing strength.

On the contrary, if the temperatures of the fixing roller and/or the fixing film are excessively high, the toner is sufficiently fused, but its viscosity is lowered and the fused toner partially falls out of the recording material, contaminating the fixing-roller surface. This phenomenon is called "hot offset", which results in a missing part of the image appearing on the recording material as in a cold offset.

Therefore, in order to prevent the above-described fixing offsets, Japanese Patent Application Laid-Open No. H08-184992 proposes the addition of wax components to toner as a release agent. The inclusion of release wax in toner causes the release wax to move to the interface between the fused toner and the fixing roller when heat-fixing is performed, enhancing the withstanding of the offset phenomenon. Furthermore, Japanese Patent Application Laid-Open No. 2000-003070 proposes a technique in which two or more types of release waxes are added to toner for offset-resistibility enhancement.

A recording material is simultaneously heated and pressured by a fixing roller and a pressure roller, and then pinched and conveyed by the rollers, so that a release wax included in toner is liquefied. A majority of the release wax is fixed to the recording material together with the fused toner, while a part of the release wax vaporizes and enters a gaseous state.

Components of the evaporated release wax float in a liquid or fine solid particle state within the fixing unit depending on the temperature of the surroundings. In some cases, the floating release-wax components may adhere to various parts within the image forming apparatus.

The accumulation of such components on, for example, a recording-material conveyance roller adversely affects conveyance performance, causing, e.g., jamming of a recording material during conveyance or a decrease in the friction coefficient of the roller, and thus, is a significant problem to be solved for ensuring the reliability of the apparatus, as well as extending the life of the apparatus. Accordingly, it is necessary to take special measures, such as controlling the direction of the air flowing in the apparatus, in order to prevent the adherence of the release-wax components to the conveyance part.

Meanwhile, in recent years, there are very high demands for speeding up and downsizing of laser beam printers. An increase in the speed for performing heat-fixing processing in an image forming apparatus requires higher thermal energy and pressure than ever before. As the thermal energy provided to toner increases, the amount of evaporation of the release-wax increases, and thus, it can be anticipated that the aforementioned problems related to the adherence of evaporated release-wax components occur more frequently. Accordingly, it is important to develop a technique to collect evaporated components of a release wax included in toner in a heating and pressure-applying fixing unit.

SUMMARY OF THE INVENTION

The present invention has been made in order to solve the aforementioned problems, and a purpose of the present invention is to provide an image forming apparatus that can prevent conveyance failures resulting from evaporated components of a release wax adhering to parts within the image forming apparatus.

Another purpose of the present invention is to provide an image forming apparatus including: a fixing part that heats and fixes an unfixed toner image formed on a recording material to the recording material; an electric field generation member that forms an electric field in a space in which a component evaporated from a wax flows, the component being generated during the heating and fixing; and a collection member to which a voltage is applied, the collection member electrostatically collecting the component passing through the space in which the electric field has been formed.

A further purpose of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

First, a full-color laser beam printer, which is an image forming apparatus according to an embodiment of the present invention, will be described. Although a full-color laser beam printer including a plurality of photosensitive drums will be described as an embodiment of the present invention, the present invention is also applicable to a monochrome copier or printer including a single photosensitive drum. Accordingly, the image forming apparatus according to the present invention is not limited to full-color laser beam printers.

Figure 1:
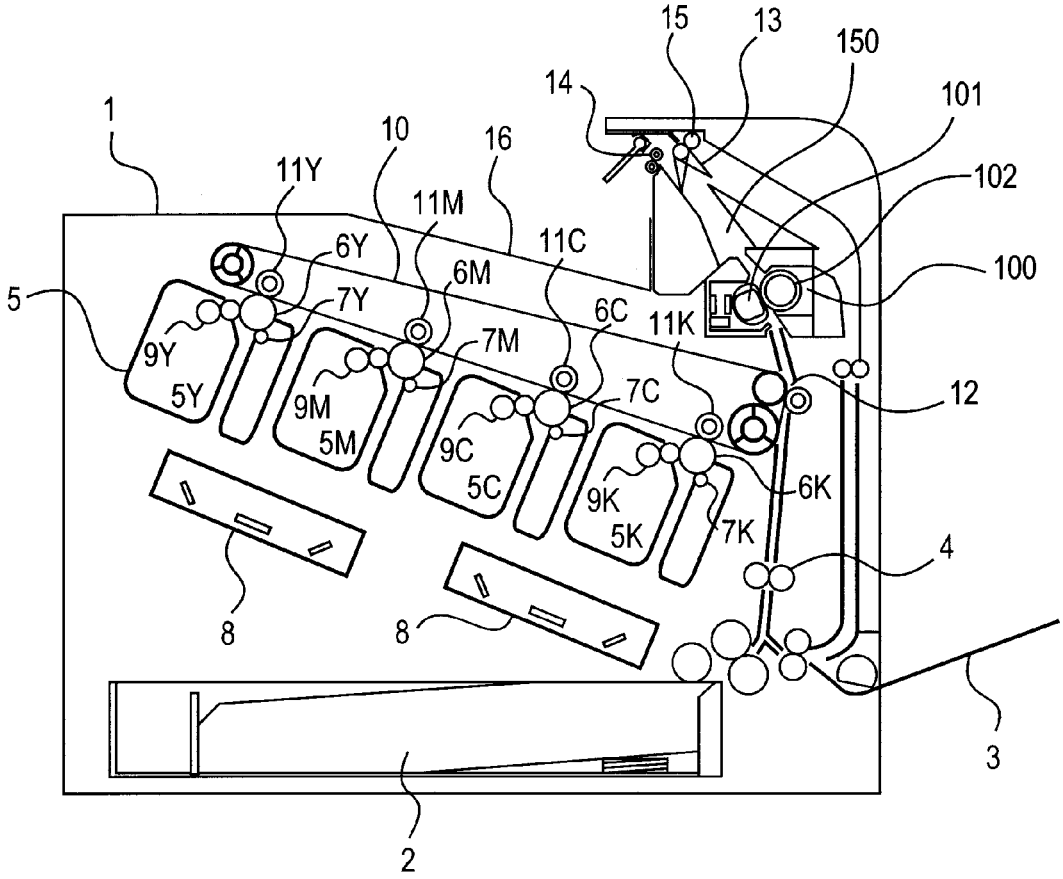
FIG. 1 is a longitudinal sectional view illustrating an overall configuration of an image forming apparatus according to an embodiment of the present invention.

FIG. 1 is a longitudinal sectional view illustrating an overall configuration of a full-color laser beam printer 1 (hereinafter, uniformly referred to as "printer 1").

A cassette 2 is housed in a lower portion of the printer 1 in such a manner that the cassette 2 can be drawn out of the printer 1. A manual feed part 3 is provided on the right side of the printer 1. Sheets, which are recording materials, are loaded in a stacked state in each of the cassette 2 and the manual feed part 3. Sheets from the cassette 2 and the manual feed part 3 are separated one by one, and fed to registration rollers 4.

The printer 1 includes an image forming part 5, which is an image forming unit in which image forming stations 5Y, 5M, 5C and 5K for respective colors, i.e., yellow, magenta, cyan and black, are transversely aligned. The image forming part 5 includes photosensitive drums 6Y, 6M, 6C and 6K (hereinafter uniformly referred to as "photosensitive drums"), which are image bearing members, and charging units 7Y, 7M, 7C and 7K that evenly charge the surfaces of the photosensitive drums 6Y, 6M, 6C and 6K, respectively. Furthermore, at a lower portion of the image forming part 5, scanner units 8 that form electrostatic latent images on the photosensitive drums 6Y, 6M, 6C and 6K by means of irradiation with a laser beam based on image information. Furthermore, developing units 9Y, 9M, 9C and 9K that make toners adhere to electrostatic latent images to develop toner images, and primary transfer parts 11Y, 11M, 11C and 11K (hereinafter uniformly referred to as "primary transfer parts") that transfer the toner images on the photosensitive drums 6Y, 6M, 6C and 6K to an electrostatic transfer belt 10, respectively, are provided. The toner images on the electrostatic transfer belt 10, respectively, which have been transferred in the primary transfer parts 11Y, 11M, 11C and 11K, are transferred to a sheet in a secondary transfer part 12.

Subsequently, the unfixed toner images formed on the sheet are heated and fixed on the sheet when passing through a fixing nip portion N including a heating unit 101 and a pressure roller 102 that is in pressure contact with the heating unit 101. Furthermore, the sheet passes through an output conveyance part 150 and is conveyed to any one of an output roller pair 14 and a switchback roller pair 15, which is determined by switching of the conveyance path via a double-side print flapper 13. The sheet conveyed to the switchback roller pair 15 side is reversed and conveyed by the switchback roller pair 15 part, passes through the registration rollers 4, the secondary transfer part 12 and a fixing unit 100 again, and then passes through the output conveyance part 150. The sheet is then conveyed to the output roller 14 side. The sheet passes through the output roller pair 14 and then is output to a sheet stacking part 16.

Figure 2:
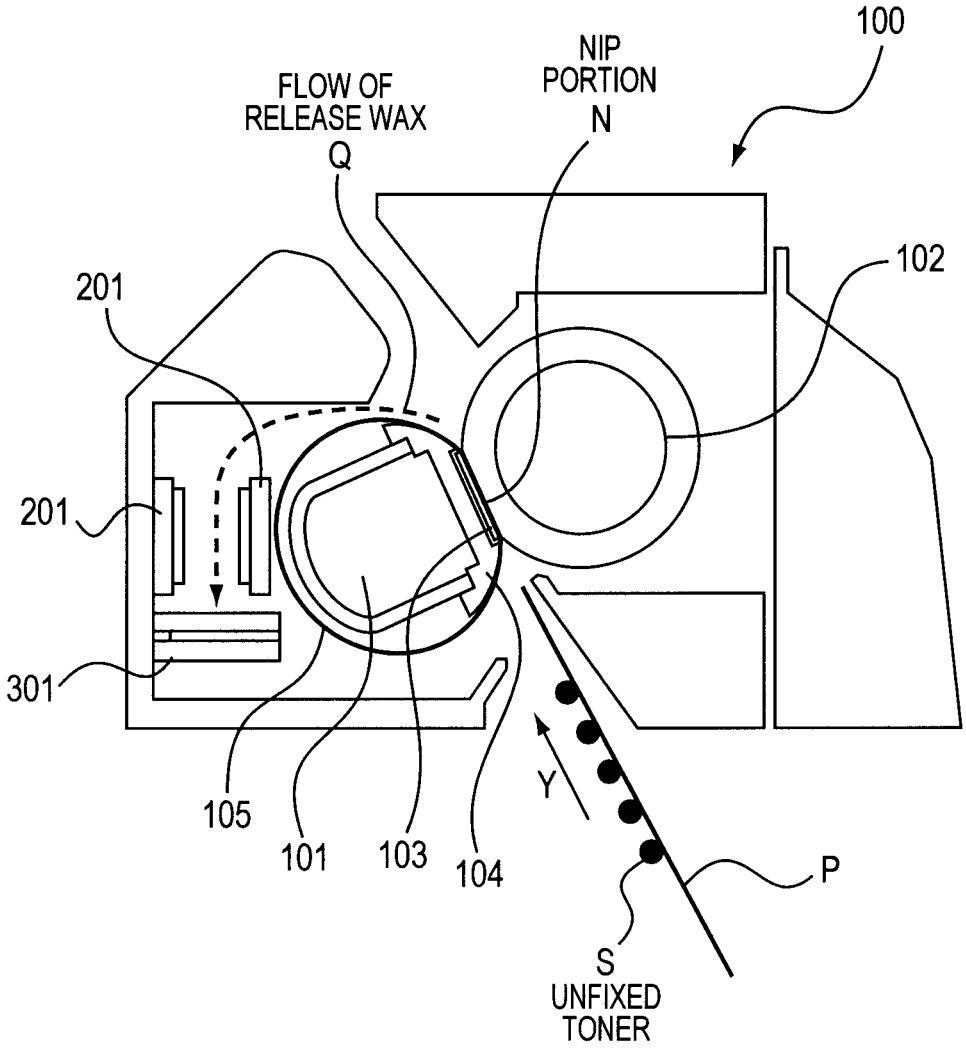
FIG. 2 is a longitudinal sectional view illustrating a configuration of a fixing unit provided in an image forming apparatus according to a first embodiment of the present invention.

Next, a detailed configuration of the fixing unit (fixing part) 100 of the printer 1 will be described with reference to FIG. 2. FIG. 2 is a longitudinal sectional view of the fixing unit 100 according to the first embodiment. The fixing unit 100 includes a heating unit 101 and a pressure roller 102, which is a pressure rotating body. The heating unit 101 and the pressure roller 102 are each housed in a frame member.

The heating unit 101 includes a heater 103, which is a heating unit. The heater 103 is supported by a heater holder 104, which is a support member. The heater holder 104 is formed in a substantially semicircular gutter shape in cross section using a heat resistant resin having heat resistance and slidability, such as a liquid crystal polymer. The heater holder 104 is sheathed with a fixing sleeve 105, which is a heating rotating body. The fixing sleeve 105 is resistant to thermal and mechanical stress, and includes a base layer of a metal with good heat conductivity, for example, SUS, coated with, for example, a PFA resin with good releasability, in order to ensure the capability of separation of the sheet P.

The pressure roller 102 includes an elastic layer formed by, e.g., silicone rubber in its metal core bar, and a surface layer coated with a fluorine-contained resin, such as PFA, having good releasability as with the fixing sleeve. The pressure roller 102 is pressed against the fixing sleeve 105 so as to face the heater 103 supported by the heater holder 104, thereby forming the fixing nip portion N between the fixing sleeve 105 and the pressure roller 102.

Although not illustrated, a heater drive control circuit, which is a control unit for the heater 103, includes a power-feeding unit such as a triac, and, e.g., a CPU for controlling the same. Upon a print signal being input to the heater drive control circuit, the CPU controls the power-feeding unit to start power supply to the heater 103. Consequently, the temperature of the heater 103 rapidly increases. The temperature of the heater 103 is detected by a thermistor (not illustrated), which is a temperature detection unit provided on a back surface (a surface opposite to the fixing nip portion N) of the heater 103. Based on the detected temperature, the heater 103 is controlled to adjust the temperature thereof to a predetermined target set temperature to heat the fixing sleeve 105 to such a temperature. In the embodiment of the present invention, the set temperature is, for example, 180° C.

In such state, the sheet P bearing unfixed toner (S in FIG. 2) is guided into the fixing nip portion N in the sheet-conveyance direction indicated by arrow Y. The sheet P is pinched and conveyed by the fixing nip portion N (see FIG. 2). In the conveyance process, the heat of the heater 103 is provided to the sheet P via the fixing sleeve 105. The unfixed toner (S) is fixed on the sheet P surface by the heat of the heater 103 and the nip pressure. The sheet P coming out of the fixing nip portion N is self-stripped from the curved surface of the fixing sleeve 105 and conveyed to the output roller pair 14 or the switchback roller pair 15.

A release wax is included in the toner and comes out of the inside of the toner punctured by the pressure of the fixing nip portion N as the sheet P is pinched and conveyed by the fixing nip portion N. Furthermore, the temperature of the release wax is brought to its melting point or higher by the heat of the fixing nip portion N, and the release wax enters a liquid or gaseous state. The melting point of the release wax used in the embodiment of the present invention is, for example, 76° C.

Components evaporated from the liquid or gaseous release wax are generated from the print surface side of the sheet P, and move according to air flows in the fixing unit 100. The air flows in the fixing unit 100 are generated by thermal convection according to the temperatures in the fixing unit 100, air flows according to rotation of the fixing sleeve 105 and the pressure roller 102 and an air flow generated as a result of conveyance of the sheet P. Among such air flows, the air flows according to rotation of the fixing sleeve 105 and the pressure roller 102 are larger than the others, that is, the heat convention and the air current generated as a result of conveyance of the sheet P, constitute a major part of the air flows in the fixing unit 100. Furthermore, the components evaporated from the release wax are generated on the print surface side in the fixing nip portion N provided by the fixing sleeve 105 and the pressure roller 102, and thus, move mainly along the air flow according to rotation of the fixing sleeve 105.

In FIG. 2, the fixing sleeve 105 rotates counterclockwise. In such case, the air surrounding the fixing sleeve 105 also flows counterclockwise, accompanying the rotation of the fixing sleeve 105. The components evaporated from the release wax, which are carried by such flow of the air, pass through an electric field generation unit (electric field generation member) 201.

Figure 3:
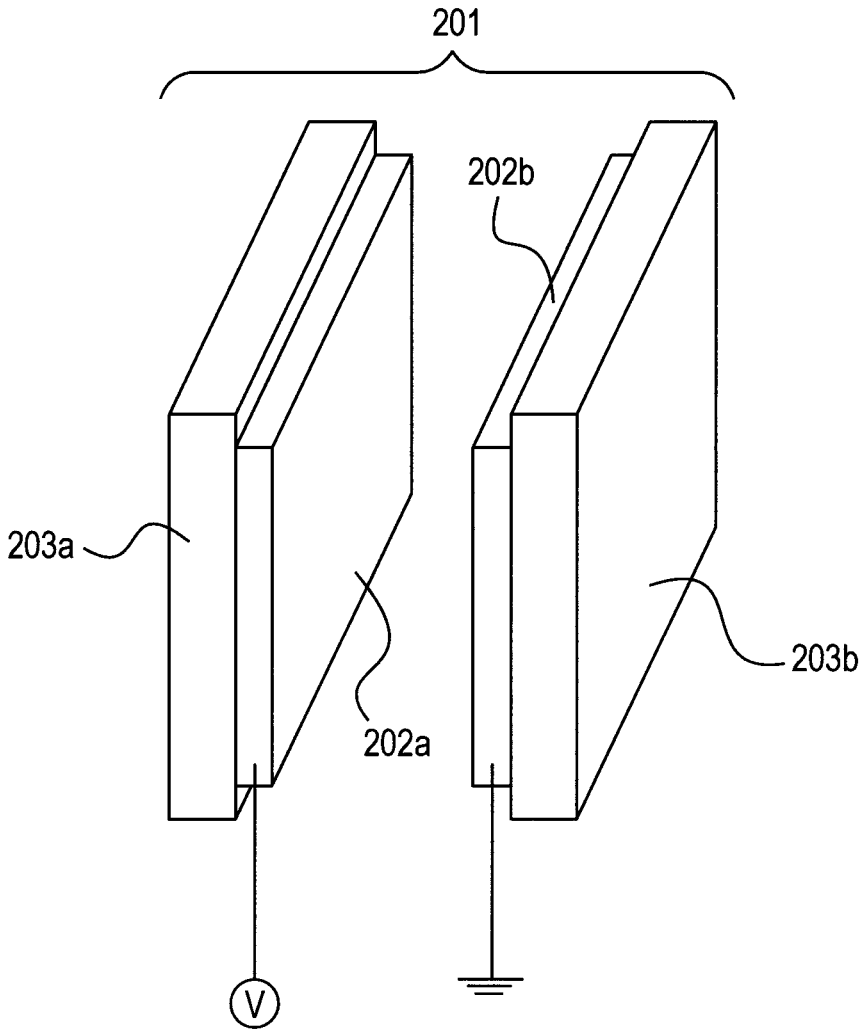
FIG. 3 is a perspective view illustrating an overall configuration of an electric field generation unit according to the first embodiment of the present invention.

FIG. 3 is a perspective view illustrating an overall configuration of the electric field generation unit 201 according to the first embodiment of the present invention. The electric field generation unit 201 is provided on a side in which the heating rotating body is housed. The electric field generation unit 201 includes metal plates 202*a* and 202*b*. A positive or negative voltage is applied to one of the two metal plates in the electric field generation unit 201, and a voltage of 0 V or a polarity opposite to that of the one metal plate is applied to the other metal plate. Each of the voltages in the embodiment of the present invention is, for example, around 3 to 4 kV. However, the applied voltage required in this case varies depending on the compositions of the toner and the wax used in the image forming apparatus and the system conditions. The metal plates 202*a* and 202*b* are held by resin members 203*a* and 203*b*, and secured to the fixing unit 100.

Figure 4B:
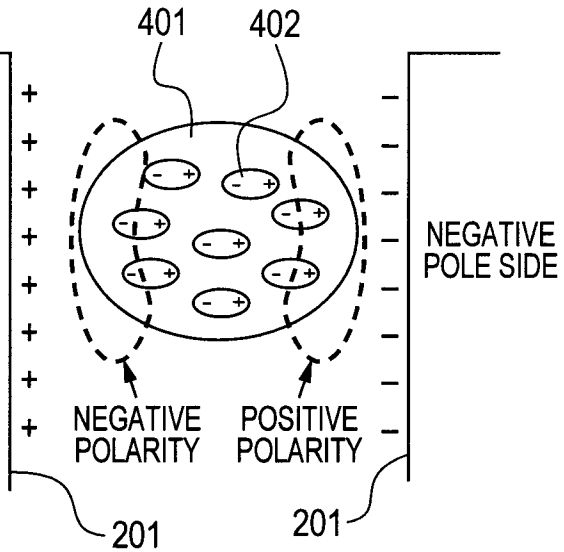
FIGS. 4A and 4B are diagrams illustrating an electrical bias of evaporated components of a release wax when passing through the electric field generation unit.
Figure 4A:
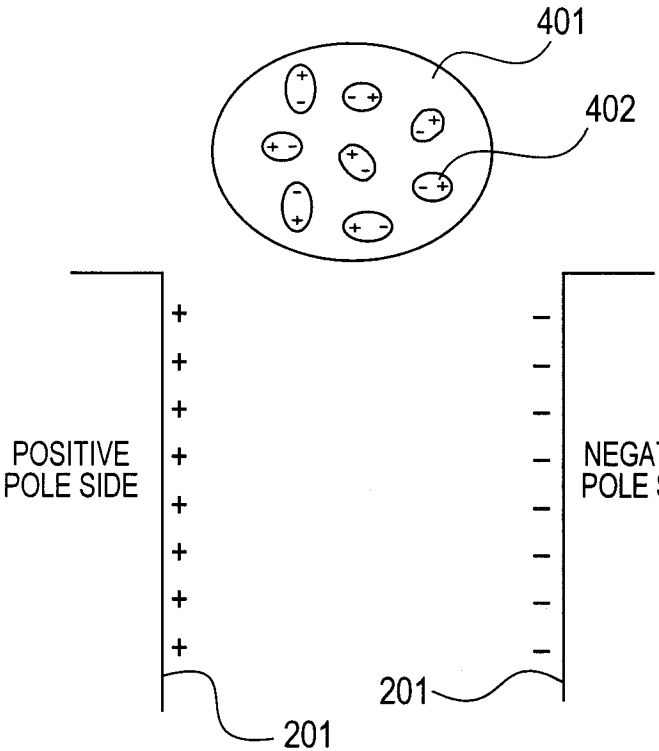

FIGS. 4A and 4B are diagrams illustrating an electrical bias of components evaporated from a release wax when passing through the electric field generation unit 201. In the inside of a release-wax particle 401, a plurality of release-wax molecules 402 is included. In general, a molecule in which the centers of gravity of positive charge (borne by the atom core) and negative charge (borne by the electrons) do not correspond to each other is called a polar molecule, which has an electrical bias in the molecule. In a state such as a liquid or gas, the release wax molecules 402 freely move within the release-wax particle 401, and in addition, in a state in which there are no external forces, the release wax molecules 402 move randomly, and thus, no electrical bias can be seen in the release-wax particle 401 macroscopically (FIG. 4A).

However, when an external force, such as an electric field, is exerted on the release-wax particle 401, the electric field makes the negative pole sides of the release wax molecules 402 be attracted by the positive pole side of the electric field generation unit 201 and makes the positive pole sides of the release wax molecules 402 be attracted by the negative pole side of the electric field generation unit 201. Consequently, as illustrated in FIG. 4B, the release wax molecules 402 are arranged in order, and from a bid viewpoint, an electrical bias can be seen in the release-wax particle 401. Here, particles of the components evaporated from the release wax move along an air flow. Thus, like the flow of evaporated components of the release wax (Q in FIG. 2), the particles pass through the electric field generation unit 201 in the electrically-biased state without adhering to the electric field generation unit 201. The particles of the evaporated release-wax components that have passed through the electric field generation unit 201 are made to electrostatically adhere to and are collected by a collection unit (collection member) 301 arranged so as to be orthogonal to a flow path formed by the electric field generation unit 201.

Figure 5:
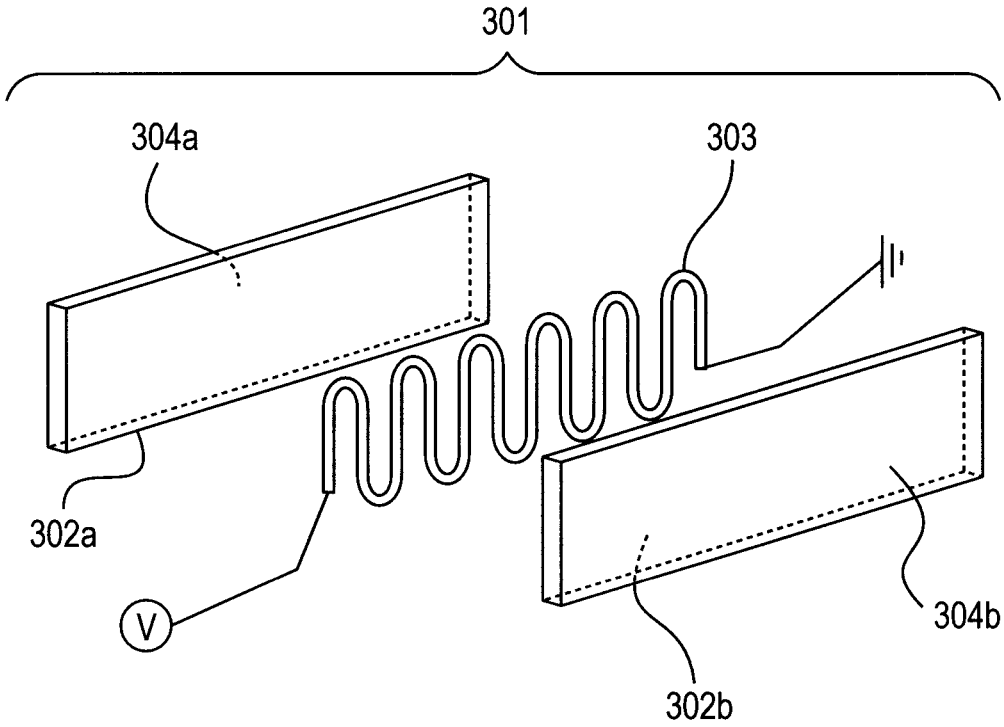
FIG. 5 is a perspective view illustrating an overall configuration of a collection unit according to the first embodiment of the present invention.

FIG. 5 illustrates a configuration of the collection unit 301. The collection unit 301 is configured so that an electrode 303 is sandwiched by collection plates 302*a* and 302*b*, which include a heat resistant resin material (for example, PET or PBT). Such a configuration is provided to prevent an electric-field-effect decrease resulting from components evaporated from the release wax adhering to the electrode 303, and to increase a surface area for collecting components evaporated from the release wax. Upon a voltage being applied to the electrode 303, an electric field is generated on collection plate surfaces 304*a* and 304*b*, enabling components evaporated from the release wax, which have been electrically biased, to be electrostatically pulled and collected on the collection plate surfaces 304*a* and 304*b*.

Figure 6:
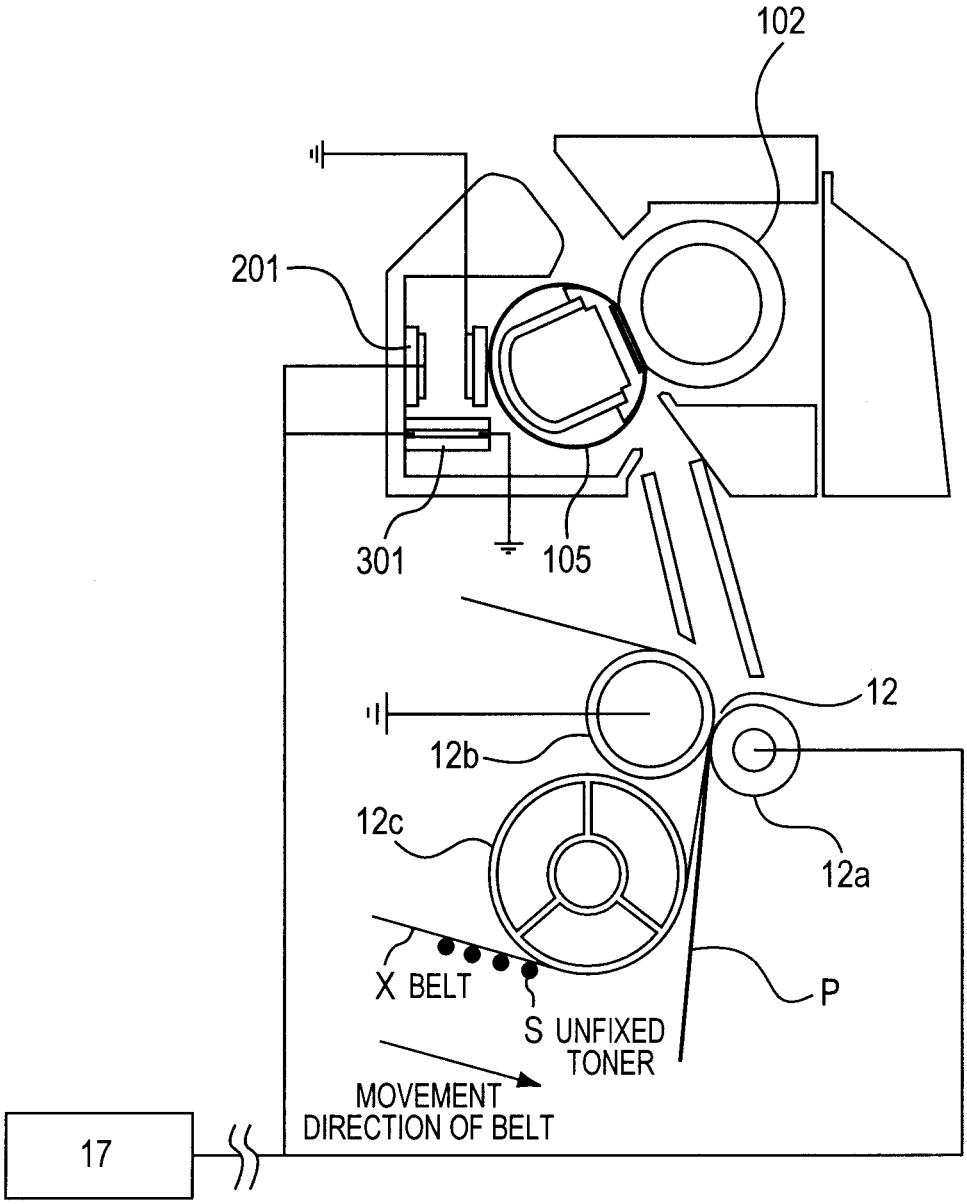
FIG. 6 is a diagram illustrating a path of power supply to the electric field generation unit and the collection unit.

FIG. 6 illustrates a voltage supply unit for the electric field generation unit 201 and the collection unit 301. In the secondary transfer part 12, which has a common configuration in the electrophotographic technology, in order to transfer unfixed toner (S) on a sheet P on a belt X, which is moved by a drive roller 12*c*, a transfer bias is applied to a transfer roller 12*a*, and an opposing roller 12*b* is grounded. In the first embodiment, the transfer bias is, for example, 3 to 6 kV, and is supplied from a power supply unit 17.

Furthermore, in the embodiment of the present invention, voltages required for the electric field generation unit 201 and the collection unit 301 are supplied through supply paths branching from the above-described supply path of the transfer bias from the power supply unit 17 to the transfer roller 12*a*. It should be noted that a voltage may be applied to at least one of the electric field generation member and the collection member using a power supply used for the image forming part.

It is also common to apply a bias voltage to the fixing sleeve and the pressure roller as a countermeasure for a fixing offset causing toner to adhere to the fixing sleeve side in the fixing unit. Accordingly, a voltage may be applied to the electric field generation unit 201 and/or the collection unit 301 through a power supply path branching from the supply path of the bias.

As described above, power is supplied to the electric field generation unit 201 and the collection unit 301 through voltage supply paths branching from a voltage supply path for the existing image forming process, eliminating the need to separately provide a dedicated power supply, enabling the provision of the configuration according to the present proposal at a minimum cost.

Figure 7B:
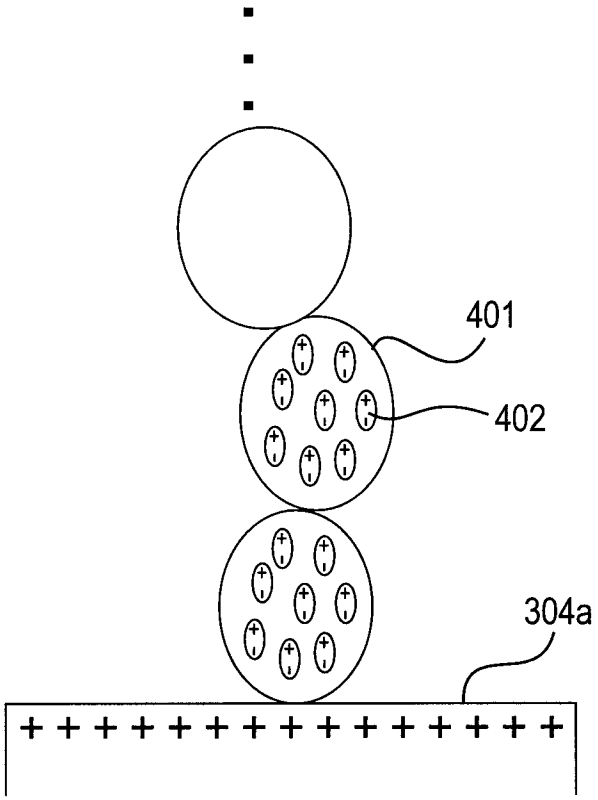
FIGS. 7A and 7B are diagrams each illustrating a manner in which evaporated release-wax components are collected by the collection unit.
Figure 7A:
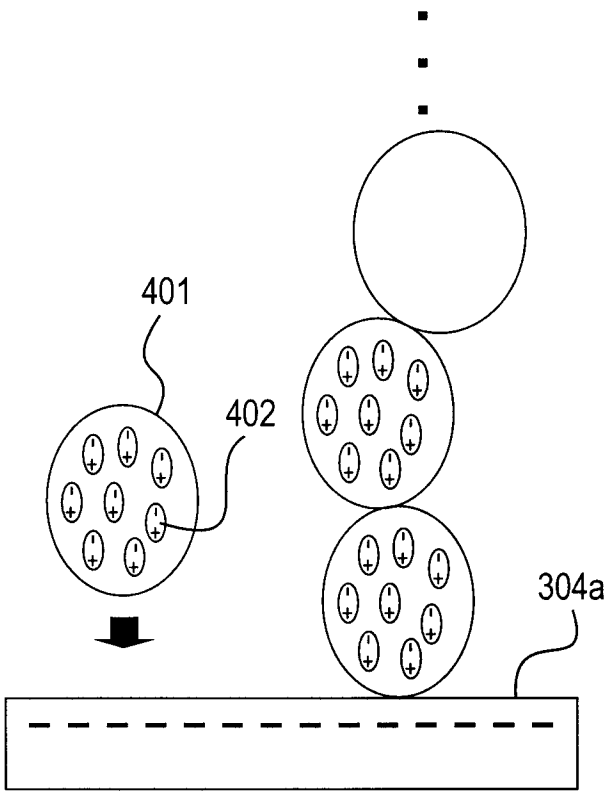

FIGS. 7A and 7B are diagrams each illustrating a manner in which components evaporated from a release wax, to which a voltage is applied by the collection unit 301, are collected. FIG. 7A illustrates a case where the collection plate surface 304*a* has a negative potential, and FIG. 7B illustrates a case where the collection plate surface 304*a* has a positive potential.

In FIG. 7A, since the collection plate surface 304*a* has a negative potential, a side biased to a positive potential of each of release-wax particles, which have been electrically biased as a result of passing through the electric field generation unit 201, adheres to the collection plate surface 304*a*. Here, a side of the particle not adhering to the collection plate surface 304*a* has a negative potential, and thus, exerts a force attracting a positive pole side of a following release-wax particle, causing the evaporated release-wax components to attach to and collect on the collection plate surface 304*a*. Since such effect occurs repeatedly, the release-wax particles are strung together.

Also, in the case of FIG. 7B, a negative pole side of a release-wax particle is attracted and adheres to the collection plate surface 304*a*. The release-wax particles are strung together as described for the case of FIG. 7A.

Where the release wax and the collection plate surface 304*a* have a temperature equal to or higher than the melting point of the release wax, the release wax is liquefied, and thus, the release-wax particles are not strung together, but exhibit the same electrical effect.

As described above, when an electric field is applied to components evaporated from a release wax, which are generated as a result of the release wax being heated by the fixing unit, by means of the electric field generation unit, the release-wax particles can be electrically biased, enabling the components evaporated from the release wax to be electrostatically collected. Accordingly, an image forming apparatus that can prevent conveyance failures resulting from evaporated components of a release wax adhering to parts within the image forming apparatus, such as a sheet guide and/or a conveyance roller, can be provided.

Second Embodiment

Next, a second embodiment of the present invention will be described. In the second embodiment, components that are the same as those in the above-described first embodiment are provided with same reference numerals, and a description of such same components is omitted to avoid overlap.

Figure 8:
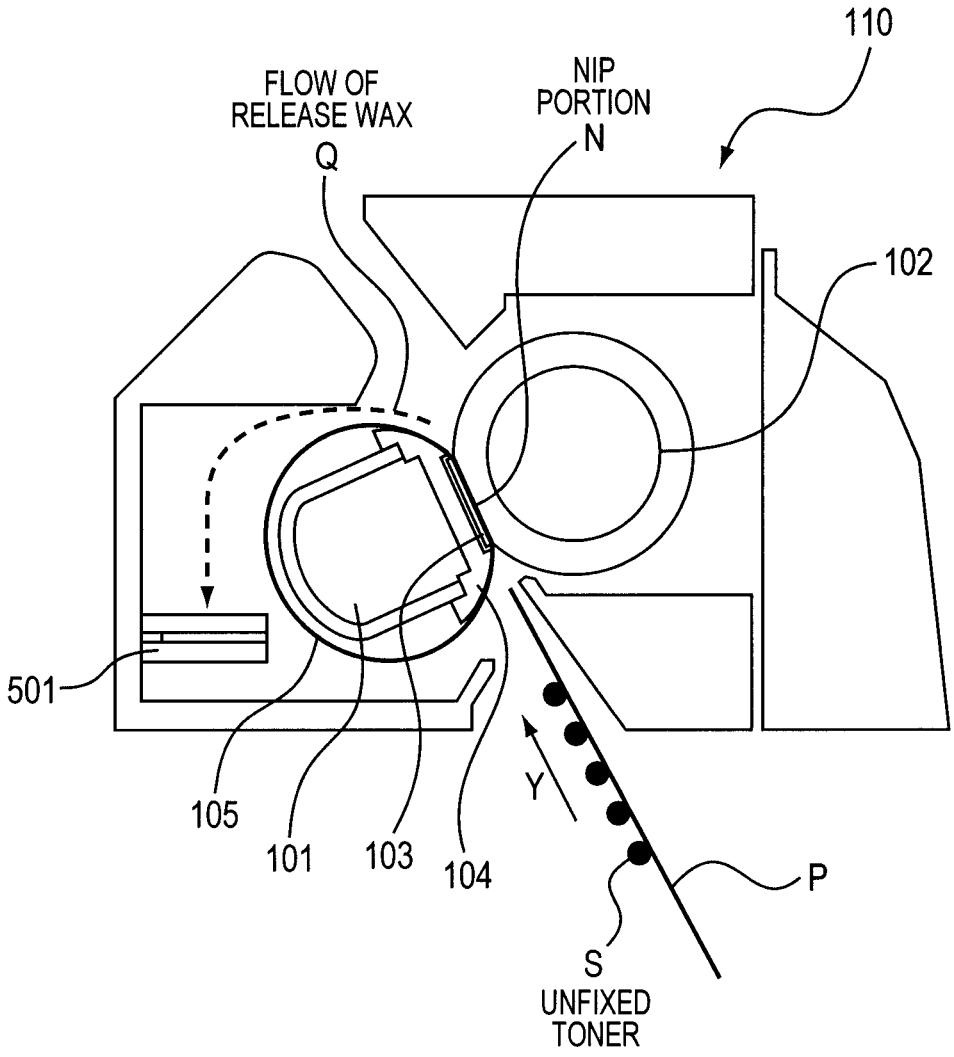
FIG. 8 is a longitudinal sectional view illustrating an overall configuration of a fixing unit according to a second embodiment of the present invention.

FIG. 8 is a longitudinal sectional view illustrating an overall configuration of a fixing unit 110 according to a second embodiment of the present invention, and illustrates a characteristic part that is different from the first embodiment. Accordingly, a full-color laser beam printer 1 (hereinafter referred to as "printer 1") according to the second embodiment has a configuration that is the same as that of the first embodiment except for an inner portion of a fixing unit 110.

In the fixing unit 110 according to the second embodiment, a collection unit 501 enabling evaporated release-wax components to be electrically biased and electrostatically collected simultaneously is provided. In other words, the collection unit 501 according to the second embodiment has both an electric field generation function provided by the electric field generation unit 201 in the first embodiment and a collection function provided by the collection unit 301, and thus, can be called an integrated collection unit. The integrated collection unit 501 in which an electric field generation unit and a collection unit are integrated has a configuration that is the same as that of the collection unit 301 in FIG. 5, and thus, a description thereof will be omitted.

However, it is necessary that an applied voltage be higher than that of the collection unit 301 in the first embodiment. In the second embodiment, a voltage of, for example, around 5 to 6 kV is applied to the integrated collection unit 501.

In the first embodiment, the evaporated release-wax components are electrically biased in the electric field generation unit 201, and thus, in the collection unit 301, the release-wax particles can be attracted even with a weak electric field. Meanwhile, in the integrated collection unit 501, it is necessary to electrically bias the release-wax particles and attract and collect the electrically biased release-wax particles simultaneously. Furthermore, as opposed to the electric field generation unit 201, in the integrated collection unit 501 where a resin member is present on a surface of an electrode, the electric field is weakened by the amount of the thickness of the resin member. Accordingly, it is necessary to apply a voltage higher than that of the electric field generation unit 201 to the collection unit 501 in the second embodiment.

Accordingly, an image forming apparatus that can prevent conveyance failures resulting from evaporated components of a release wax adhering to parts within the image forming apparatus, such as a sheet guide and/or a conveyance roller, can be provided. In particular, in the second embodiment, an integrated collection unit simultaneously providing a function that electrically biases particles of evaporated release-wax components and a function that electrostatically collets the evaporated release-wax components is provided. Thus, such an integrated collection unit can be arranged in a space that is smaller than that required for separately arranging apparatuses having the respective functions, enabling a reduction of costs of the members.

Third Embodiment

Next, a third embodiment of the present invention will be described. In the third embodiment, components that are the same as those in the above-described first or second embodiment are provided with same reference numerals, and a description of the same components will be omitted to avoid overlap.

Figure 9:
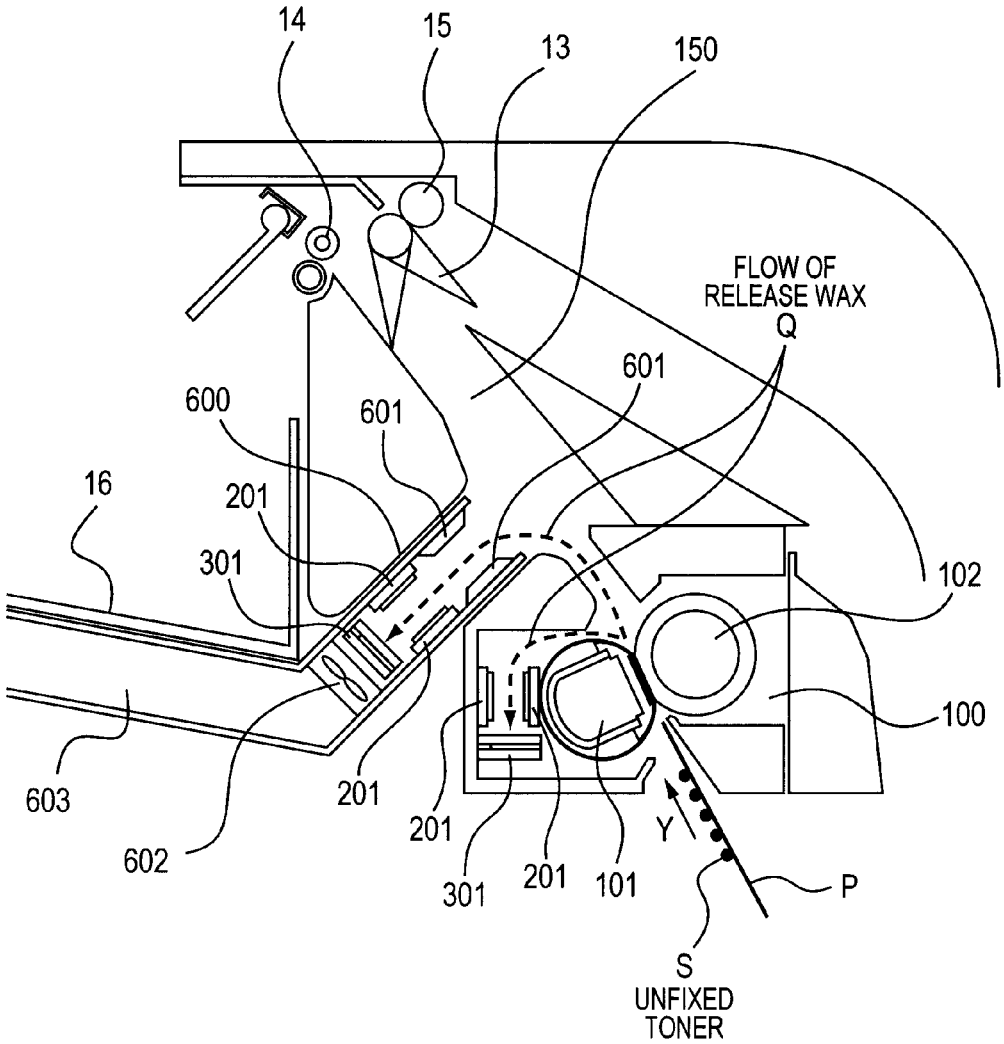
FIG. 9 is a longitudinal sectional view illustrating an overall configuration of a fixing unit and its peripheral units according to a third embodiment of the present invention.

FIG. 9 is a longitudinal sectional view illustrating an overall configuration of a fixing unit and peripheral units according to a third embodiment of the present invention. An image forming apparatus according to the third embodiment is different from the image forming apparatus according to the first or second embodiment in that a second collection system 600 including an electric field generation function that provides an electric field to components evaporated from a release wax and a collection function that collects the evaporated components to which the electric field has been applied is further provided downstream in a sheet P conveyance direction of the fixing unit in addition to a fixing unit. The fixing unit included in the image forming apparatus according to the third embodiment may be the fixing unit 100 in the first embodiment or the fixing unit 110 in the second embodiment. The below description is provided on the premise that the fixing unit 100 is provided. As described above, the fixing unit 100 includes an electric field generation unit 201 and a collection unit 301, which are collectively referred to as a first collection system below.

As described above, basically, evaporated release-wax components are electrically collected within a fixing unit in which a source of generation of the components exists. However, a part of the evaporated release-wax components may be carried by thermal convection and/or an air flow generated as a result of a sheet P being conveyed and discharged to the outside of the fixing unit. FIG. 9 illustrates a configuration provided to collect such a part of the evaporated release-wax components.

The second collection system 600 includes a fan 602 and a duct 603, and uses the fun 602 and the duct 603 to forcibly generate an air flow, thereby drawing evaporated release-wax components into the duct 603. In the duct 603, a heater 601 is arranged. The heater 601 is a heating unit that can re-heat the release wax discharged to the outside of the fixing unit 100 by the thermal convection or the air flow generated as a result of conveyance of the sheet P to a temperature equal to or higher than a melting point of the release wax. Also, in the duct 603, an electric field generation unit 201 and a collection unit 301, which are illustrated in FIGS. 3 and 5, respectively, are arranged. In the second collection system 600, a collection unit 501, which is described in the second embodiment, may be arranged rather than the aforementioned electric field generation unit 201 and collection unit 301.

The evaporated release-wax components discharged to the outside of the fixing unit 100 by the thermal convection or the air flow generated as a result of conveyance of the sheet P are forcibly drawn into the duct 603 by the air flow generated by the fan 602. Concurrently, the evaporated release-wax components are heated by the heater 601 to the temperature equal to or higher than the melting point, and thus, enter a liquid or gaseous state. The evaporated release-wax components that have been made into such state pass through the electric field generation unit 201, whereby the evaporated release-wax components are electrically biased, and pulled and collected by the collection unit 301.

Accordingly, an image forming apparatus that can prevent conveyance failures resulting from evaporated components of a release wax adhering to parts within the image forming apparatus, such as a sheet guide and/or a conveyance roller, can be provided. In particular, in the third embodiment, evaporated release-wax components discharged to the outside of the fixing unit because of failure to collect the evaporated release-wax components within the fixing unit can also be collected. Accordingly, evaporated release-wax components can be prevented more reliably from adhering to parts within the image forming apparatus, enabling prevention of conveyance failures.

Although in the above-described second collection system, an electric field generation unit and a collection unit are separately provided, it should be understood that the electric field generation unit and the collection unit can be provided by an integrated collection unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-107939, filed May 10, 2010, which is hereby incorporated by reference herein in its entirety.

What is claimed is:

1. An image forming apparatus comprising:

a fixing part that heats and fixes an unfixed toner image, including a wax and formed on a recording material, onto the recording material;

an electric field generation member that forms an electric field in a space in which a component evaporated from the wax flows, the component being generated during the heating and fixing of the unfixed toner image by the fixing part; and a collection member to which a voltage is applied, the collection member electrostatically collecting the component passing through the space in which the electric field has been formed.

2. An image forming apparatus according to claim 1, wherein the electric field generation member and the collection member are provided inside a frame member of the fixing part.

3. An image forming apparatus according to claim 1, further comprising an image forming part that forms the unfixed toner image on the recording material, wherein a voltage is applied to at least one of the electric field generation member and the collection member, using a power supply used for the image forming part.

4. An image forming apparatus according to claim 1, wherein a voltage is applied to at least one of the electric field generation member and the collection member, using a power supply used for the fixing part.

* * * * *